US008985162B2

(12) United States Patent
Aneas

(10) Patent No.: US 8,985,162 B2
(45) Date of Patent: Mar. 24, 2015

(54) DEVICE FOR CONNECTION BETWEEN A RECIPIENT AND A CONTAINER AND METHOD FOR ASSEMBLING AND USING SUCH A DEVICE

(75) Inventor: Antoine Aneas, Menetrol (FR)

(73) Assignee: Biocorp Recherche et Developpement, Issoire (FR)

( * ) Notice: Subject to any disclaimer, the term of this patent is extended or adjusted under 35 U.S.C. 154(b) by 0 days.

(21) Appl. No.: 14/123,116

(22) PCT Filed: Jun. 5, 2012

(86) PCT No.: PCT/EP2012/060591

§ 371 (c)(1),
(2), (4) Date: Nov. 29, 2013

(87) PCT Pub. No.: WO2012/168235

PCT Pub. Date: Dec. 13, 2012

(65) Prior Publication Data

US 2014/0096862 A1 Apr. 10, 2014

(30) Foreign Application Priority Data

Jun. 6, 2011 (FR) ..... 11 54884

(51) Int. Cl.
*B65B 3/04* (2006.01)
*B65B 3/00* (2006.01)
*A61J 1/20* (2006.01)

(52) U.S. Cl.
CPC ..... *B65B 3/003* (2013.01); *A61J 1/2089* (2013.01); *A61J 1/2096* (2013.01); *A61J 2001/201* (2013.01); *A61J 2001/2055* (2013.01); *A61J 2001/2065* (2013.01)
USPC ..... 141/1; 141/329; 141/330; 604/414

(58) Field of Classification Search
CPC ..... A61J 1/2096
USPC ..... 141/21–27, 326, 329–330, 1, 2; 604/411, 414
See application file for complete search history.

(56) References Cited

U.S. PATENT DOCUMENTS

| | | | | |
|---|---|---|---|---|
| 3,940,003 | A * | 2/1976 | Larson | 215/247 |
| 3,977,555 | A * | 8/1976 | Larson | 215/247 |
| 4,576,211 | A * | 3/1986 | Valentini et al. | 141/329 |
| 8,262,641 | B2 * | 9/2012 | Vedrine et al. | 604/411 |
| 8,454,573 | B2 * | 6/2013 | Wyatt et al. | 604/414 |
| 2003/0105430 | A1 | 6/2003 | Lavi et al. | |

FOREIGN PATENT DOCUMENTS

| | | |
|---|---|---|
| FR | 2717086 A1 | 9/1995 |
| GB | 2446778 A | 8/2008 |

OTHER PUBLICATIONS

Search Report for Patent Application No. PCT/EP2012/060591.

* cited by examiner

*Primary Examiner* — Timothy L Maust
*Assistant Examiner* — Timothy P Kelly
(74) *Attorney, Agent, or Firm* — Soquel Group LLC

(57) ABSTRACT

A device connecting a recipient closed by a perforatable stopper and a container for a needle, comprising a base for mounting the container, the base defining a central bore and comprising means for mounting on the recipient, the needle pertaining to a subset engaged in the central bore forming part of the device, for mounting on the container, and being arranged in the central bore parallel to the bore's longitudinal axis, and a sealing sleeve arranged in the central bore, around the needle and in contact therewith, the base being a single component and comprising a body for perforating the stopper extending from an intermediate wall of the base, away from the central bore and parallel to its central axis, up to a distal end, the perforating body being hollow and the inner space thereof communicating with the central bore and with a space radially surrounding its distal end.

15 Claims, 7 Drawing Sheets

DEVICE FOR CONNECTION BETWEEN A RECIPIENT AND A CONTAINER AND METHOD FOR ASSEMBLING AND USING SUCH A DEVICE

CROSS-REFERENCES TO RELATED APPLICATIONS

This application claims priority benefit under 35 U.S.C. §371 to International Patent Application No. PCT/EP2012/060591 entitled DEVICE FOR CONNECTION BETWEEN A RECIPIENT AND A CONTAINER AND METHOD FOR ASSEMBLING AND USING SUCH A DEVICE, and filed by inventor Antoine Aneas on Jun. 5, 2012. International Patent Application No. PCT/EP2012/060591 claims priority to French Patent Application No. 11 54884, filed by inventor Antoine Aneas on Jun. 6, 2011.

FIELD OF THE INVENTION

The invention relates to a device for a connection between a recipient provided with a neck closed off by a penetrable stopper and a container intended to be equipped with a needle, such a container for example possibly being a syringe. The invention also relates to a method for assembling such a connection device as well as a method for filling a container intended to be equipped with a needle, in which such a connection device is used.

BACKGROUND OF THE INVENTION

In the field of medicament packaging, it is known to store a freeze-dried medicament or the active ingredient of a medicament in a glass bottle, the neck of which is closed off by an elastomer stopper and crimped by an aluminum cap provided with a closure that can be torn. To reconstitute such medicaments, is known to eject the contents of the syringe into the bottle, then to recover the mixture. To that end, an equipment may be used like that described in WO-A-2006/085327, the implementation of which is relatively long and complex, inasmuch as certain manipulations, including rotations, must be done in a specific order that is not necessarily intuitive for an uninformed user. Furthermore, the known devices comprise a relatively large number of parts, which increases their cost and manufacturing time.

FR-A-2 717 086 provides for connecting a bottle to a syringe already equipped with a needle by using a guide piece that includes a cylindrical body. A fastening piece is part of a proximal end of the cylindrical shaft whereof the distal end is guided by a sleeve and forms a tip intended to penetrate a piece mounted in an end portion of the cylindrical body. This distal end is not secured to the sleeve but to the fastening piece, such that the stopper may only be penetrated by inserting the syringe provided with its needle inside the connecting device. This material therefore does not make it possible to access the inner volume of the bottle when the syringe is not in place. Furthermore, a part made from an elastic material provides sealing between the end of the syringe and the fastening piece, without coming into contact with the needle. As a result, the dead space of that material extends to the nose of the syringe, which causes significant product losses.

Furthermore, GB-A-2 446 778 discloses an adapter that is intended to cooperate with a standard syringe provided with a needle, which is not compatible with the use of a syringe without a needle. The risks of leakage around the middle of the syringe are significant, in particular when an assembly formed by a bottle, an adapter and a needle is positioned in the upside down configuration to pour the contents of the bottle into the needle.

SUMMARY

The invention more particularly aims to resolve these drawbacks by proposing a new connection device that is cost-effective and particularly easy to use.

To that end, the invention relates to a device for connection between a recipient provided with a neck closed off by a penetrable stopper and a container intended to be equipped with a needle, said device comprising a base provided with means for assembly on the recipient, which defines a central bore and on which the container can be mounted. According to the invention, a needle, belonging to a subassembly engaged in the central bore of the base that is part of the connection device and intended to be mounted on the container, is positioned in the central bore, in a direction parallel to a longitudinal axis of the bore, whereas a sealing sleeve is positioned in the central bore, around the needle and in contact therewith, the base being a single component and comprising a member penetrating the stopper that extends, from an intermediate wall of the base, opposite the central bore, parallel to its central axis and as far as the distal end, whereas the penetrating member of the stopper is hollow and its inner volume is in communication with the central bore, on the one hand, and with a volume radially surrounding the distal end of the penetrating member, on the other hand.

Owing to the invention, the connecting device according to the invention may be implemented owing to translational movements, without requiring rotation or complex movements, which is completely intuitive for a user. Furthermore, inasmuch as the needle provided to equip the container is positioned in the central bore of the base, the device according to the invention is compact and effectively protects the needle before use. In particular, the device according to the invention is compatible with the use of a syringe with no needle, since the subassembly to which the needle belongs is engaged in the central bore of the base. Since the base is a single component, the penetrating member may be provided to penetrate the stopper of the recipient due solely to the placement of that base on the neck of the recipient. The structure of the device according to the invention is also simple, which makes it possible to control its cost and manufacturing time.

According to advantageous, but optional aspects of the invention, such a device may incorporate one or more of the following features, in any technically allowable combination:

- The inner volume of the penetrating member forms a housing for partially receiving the needle.
- The part of the needle that is received in the inner volume of the penetrating member is not in contact with that member.
- The free end of the part of the needle received in the inner volume of the penetrating member is offset, in a direction parallel to the longitudinal axis of the bore, by at least 2 mm relative to the distal end of the penetrating member.
- The minimum inner diameter without strain of the sleeve is smaller than the outer diameter of the needle.
- The base and a tip secured to the needle are provided with complementary raised portions for locking the needle in a translational movement parallel to the longitudinal axis of the bore, toward the penetrating member.
- The sleeve bears, opposite the tip, against the bottom of the bore whereas, when the tip is locked against the base by cooperation of the complementary raised portions, it exerts an axial compression force on the sleeve and the sleeve is provided to expand radially under the effect of such a compression force.

The sleeve has a cylindrical outer shape with a circular base on one part, and a frustoconical shape on another part.

The penetrating member is provided to penetrate the stopper of the recipient due solely to the mounting of the base on the recipient, without any interaction with the container.

The dead space of the device extends into the inner volume of the penetrating member, into the sleeve as far as the narrow zone of that sleeve in contact with the needle and around the penetrating member.

The dead space of the device is smaller than 25 $mm^3$.

The subassembly is provided with means for removable attachment on the container.

The invention also relates to a method for assembling a device as described above that comprises the following steps:

a) engaging, owing to elastic deformation, the sleeve on a tube whereof the inner diameter is larger than the outer diameter of the needle;

b) aligning a central axis of the needle on a central axis of the tube;

c) engaging the needle in the tube with a translational movement parallel to the aligned axes;

d) separating, through a translational movement parallel to the aligned axes, the tube and a subassembly comprising at least the sleeve and the needle; and e) engaging the subassembly in the central bore of the base.

Lastly, the invention relates to a method for filling a container intended to be equipped with a needle with a product contained in a recipient provided with a neck closed off by a penetrable stopper. According to that method, a connection device is used as mentioned above and the following steps are performed:

p) mounting the base on the recipient by penetrating the stopper with the penetrating member, through an operation resulting from the movement of the base relative to the neck, in translation parallel to the central axis of the bore and toward the bottom of the recipient;

q) sealably mounting the container on a tip secured to a proximal end of the needle;

r) injecting, in the recipient, a liquid present in the container, through the central channel of the needle and the inner volume of the penetrating member;

s) positioning the recipient, the connecting device and the container assembled in a position where the contents of the recipient flow by gravity toward the inner volume of the container, through the inner volume of the penetrating member and the central channel of the needle; and t) removing the needle secured to the container from the bore.

It is in particular possible to provide that, during step p), the mounting means are elastically deformed and attach below the neck of the recipient, while keeping the penetrating member in a position where it puts the inner volume of the recipient in communication with the inner volume of a part of the subassembly in place in the central bore of the base.

BRIEF DESCRIPTION OF THE DRAWINGS

The invention will be better understood and other advantages thereof will appear more clearly in light of the following description of one embodiment of a connection device according to its principle and methods implemented using the device, provided solely as an example and done in reference to the appended drawings, in which.

DETAILED DESCRIPTION

Figure 1:
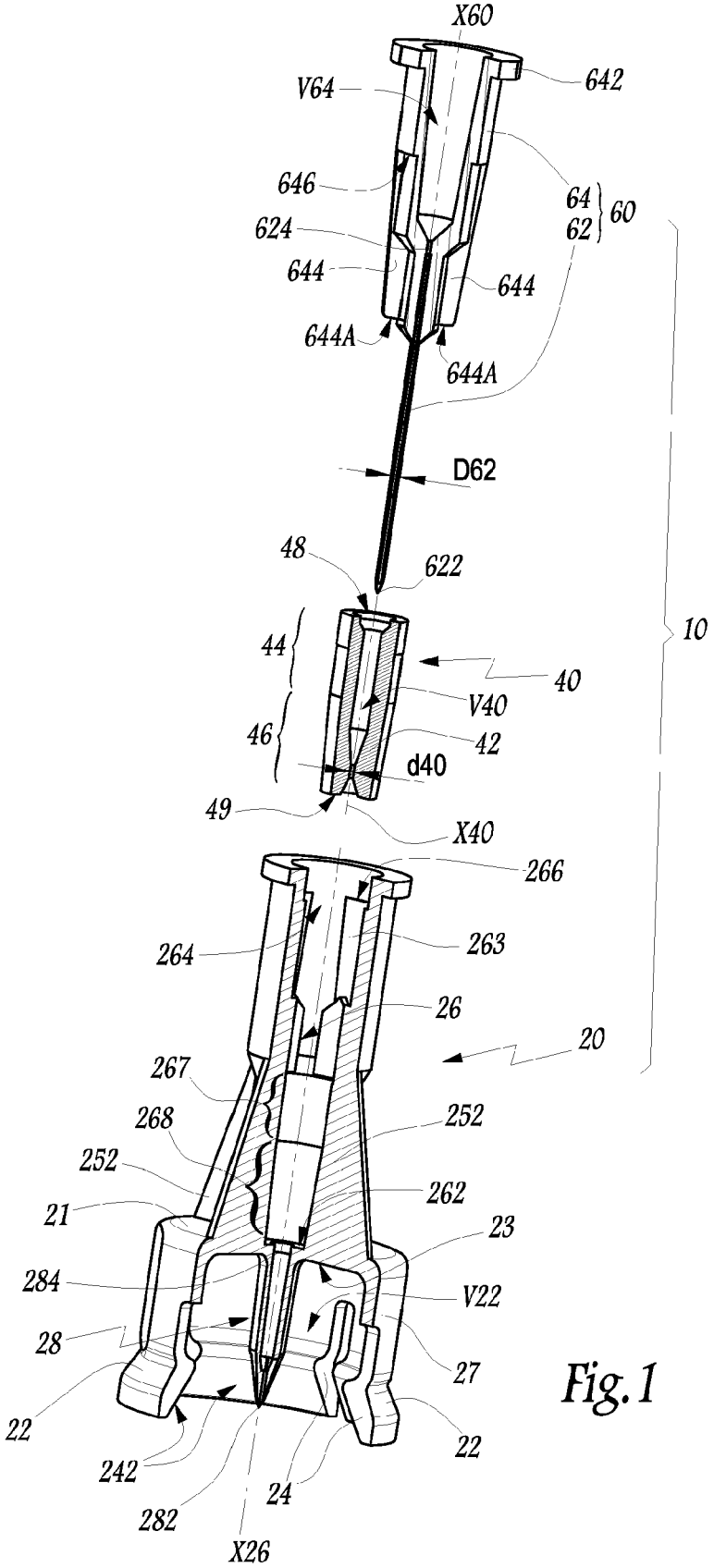
FIG. 1 is an exploded perspective view in axial cross-section, over a quarter of its circumference, of a connection device according to the invention.

The connection device 10 shown in FIGS. 1 to 4 comprises a single-component base 20 made from a molded synthetic material, for example polycarbonate or ABS.

This base 20 is provided with an annular part 21 from which four tabs 22 extend that are elastically deformable and the geometry of which allows them to be snapped around the outer collar 122 of the neck 120 of the glass bottle 110.

Figure 3:
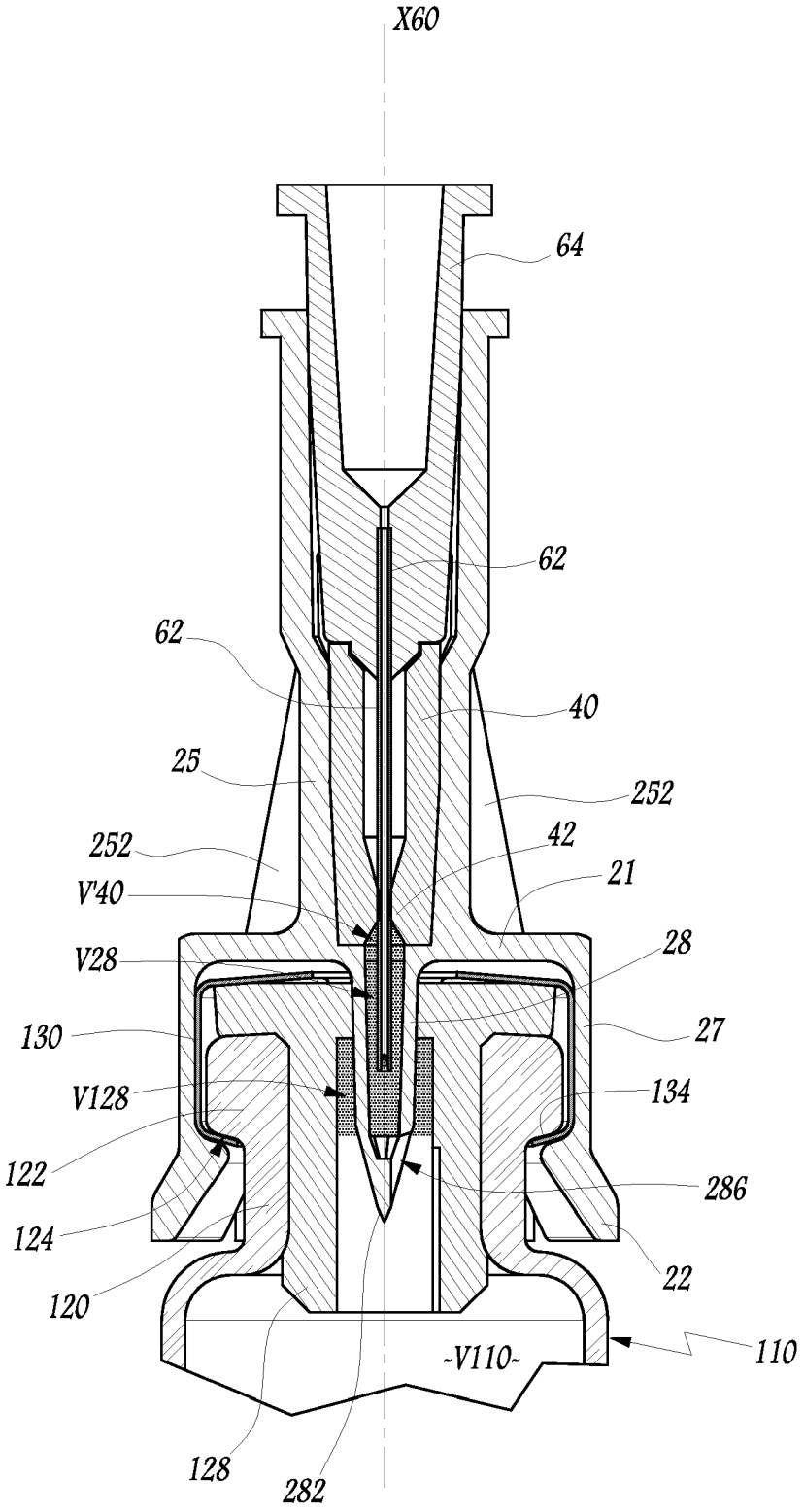
FIG. 3 is a cross-section similar to FIG. 2 when the connection device is mounted on the bottle.
Figure 4:
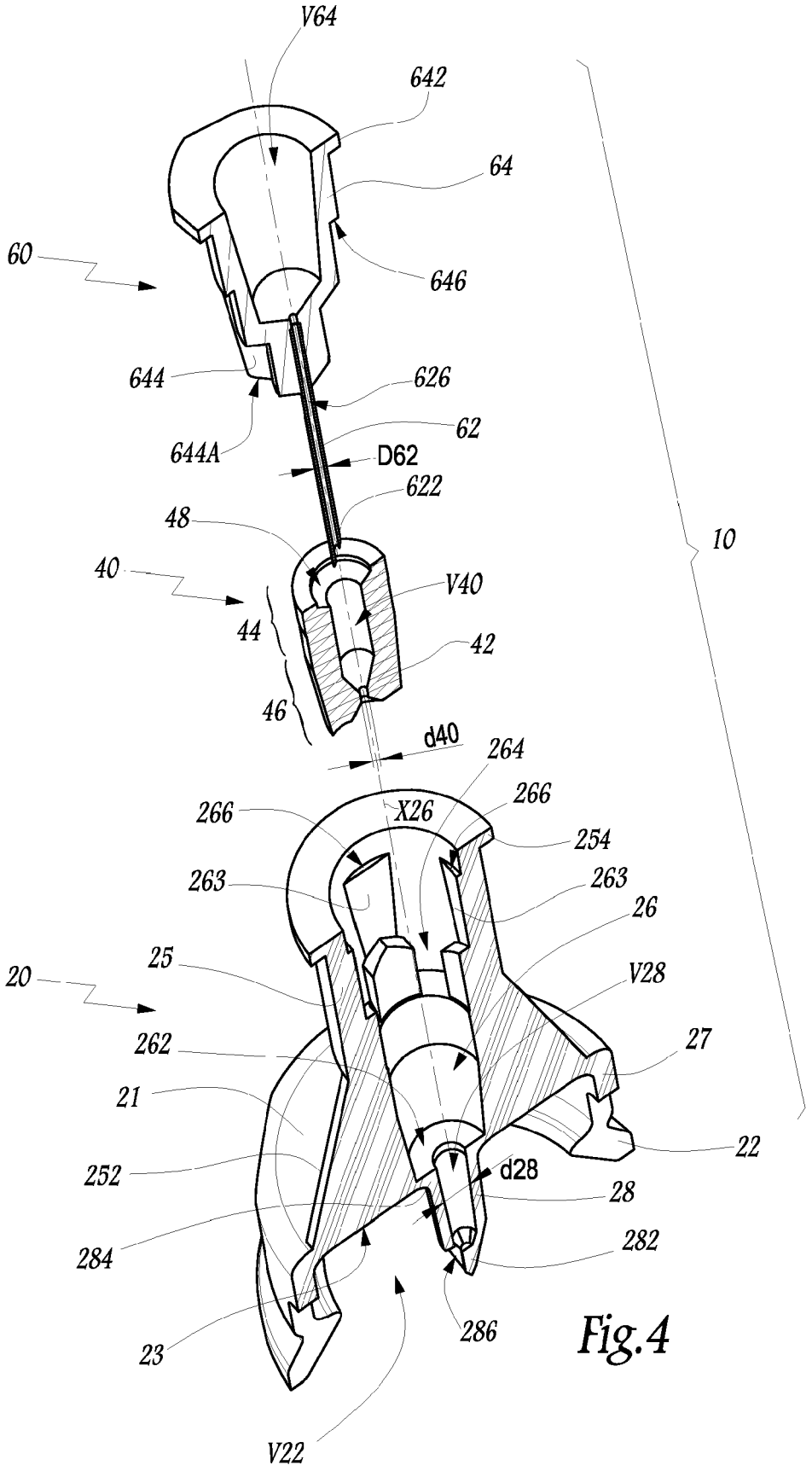
FIG. 4 is an exploded perspective view of the connection device, from another angle and in axial cross-section over its half-circumference.

The tabs 22 define a volume V22 between them for receiving the neck 120 when the device 10 is placed on the bottle 110, as shown in FIG. 3. In this configuration, an inner beak 24 of each tab 22 bears against a lower flank 134 of a cap 130 that surrounds the collar 122. This flank 134 in turn bears against a surface 124 of the collar 122 that is oriented toward the bottom 112 of the bottle 10.

The base 20 is provided with a central bore 26 whereof the longitudinal axis is denoted X26. The axis X26 constitutes a central longitudinal axis for the base 20. Four stiffening ribs 252 are formed on the outside of the tubular part 25 at the center of which the bore 26 is formed. The ribs 252 extend between the tubular part 25 and the annular part 21. Reference 23 denotes the surface of the part 21 opposite the ribs 252. The surface 23 is perpendicular to the axis X26 and the tabs 22 extend parallel to the axis X26, from a skirt 27 that surrounds that surface. The volume V22 extends as far as the surface 23 and it is surrounded, radially relative to the axis X26, by the skirt 27 near the surface 23. The part of the volume V22 closest to the surface 23 surrounds the collar 122 and the cap 130 in the configuration where the base 20 is mounted on the bottle 110.

The end of the part 25 opposite the part 21 is bordered by an outer collar 254.

The inner beaks 24 of the tabs 22 are each provided with a surface 242 oriented opposite the bore 26. The surfaces 242 are frustoconical and divergent relative to the axis X26 moving away from the bore 26. This geometry of the surfaces 242 facilitates the elastic deformation of the tabs 22 during placement of the base 20 on the neck 120 of the bottle 110, through an axial translational movement.

A hollow punch 28 extends along the axis X26, in the volume V22 and from the center of the surface 23. The punch 28 is intended to penetrate a stopper 128 made from elastomer that closes off the neck 120. In this sense, the punch 28 constitutes a penetrating member of the stopper 128.

In practice, the stopper 128 is immobilized in the neck 120 using the cap 130, which is made from aluminum or a synthetic material.

Reference 282 denotes the distal end of the punch 28, i.e., the end thereof furthest from the surface 23. Reference 284 denotes the base of the punch 28, i.e., its junction zone with the surface 23. This base constitutes the proximal end of the punch 28.

V28 denotes the inner volume of the punch 28, said inner volume being in the form of a bore centered on the axis X26.

An opening 286 is formed on one side of the punch 28, near the end 282. This opening puts the volume V28 in communication with the volume V22 that surrounds the end 282, radially relative to the axis X26.

The device 10 also comprises a single-component sealing sleeve 40 made from a synthetic or flexible natural material, such as elastomer. Alternatively, the sleeve 40 is made from injection-moldable Santoprene.

X40 denotes the longitudinal axis of the sleeve 40, and V40 denotes the inner volume of said sleeve, which is centered on the axis X40 and symmetrical relative to the axis. The diameter of the volume V40 varies over the length of the sleeve 40. More specifically, the sleeve 40 comprises a narrow zone 42 where its inner diameter has a minimum value d40 when the sleeve 40 is not stressed by outside forces.

The outer surface of the sleeve 40 comprises a cylindrical portion 44 with a circular section and centered on the axis X40, as well as a portion 46 that is frustoconical, centered on the axis X40 and converging toward the axis moving away from the portion 44.

Opposite the narrow zone 42, the volume V40 emerges outwardly, by a wider portion 48.

The bore 26 comprises two portions 267 and 268 that are cylindrical and frustoconical, respectively, and converging toward the bottom 62. The axial lengths of the portions 267 and 268 are respectively the same as those of the portions 44 and 46 of the sleeve 40.

The device 10 further comprises a subassembly 60 formed by a hollow needle 62 and a tip 64 mounted around the proximal end 624 of the needle 62. The subassembly 60. The subassembly 60 is engaged in the bore 26, where it awaits connection with a syringe, as explained hereinafter. The tip 60 is provided to be mounted reversibly on a syringe. It may be a standard commercially available product, the cost of which is well-controlled. The needle 62 is made from metal, whereas the tip 64 is made from a plastic material, for example polypropylene.

The tip 64 is provided with a collar 642 allowing it to be fastened to the end of the syringe 210, like those traditionally used to reconstitute and inject medicaments.

The inner volume V64 of the tip 64 is in communication with the central channel 626 of the needle 62. The elements 62 and 64 can be secured using any known technique, in particular by overmolding or gluing.

X60 denotes a longitudinal axis of the subassembly 60. The elements 62 and 64 are aligned and centered on the axis X60.

The tip 64 is provided with four fins 644 that extend toward the outside of the tip 64, radially relative to the axis X60. On its side, the surface of the base 20 that defines the bore 26 is provided with raised portions 263 between which guideways 264 are defined for receiving the fins 644 when the tip 64 is engaged in the bore 26, as explained hereinafter.

The cooperation of the fins 644 and the guideways 264 prevents the subassembly 60 from rotating relative to the base 20 when the tip 64 is engaged in the bore 26.

The tip 64 is also provided with an outer shoulder 646 that extends between the fins 644 and bears against a surface 266 of each raised portion 263 that is opposite the bottom 262. The cooperation of the shoulder 646 and the surfaces 266 limits the pushing of the tip 64, and consequently of the needle 62, into the bore 26, toward the volume V22.

In the assembled configuration of the device 10, the axes X26, X40 and X60 are combined and the sealing sleeve 40, in place in the bore 26, rests against the bottom 262 by its end surface 49 opposite the portion 48. In that configuration, the shoulder 646 rests on the surfaces 266 and the fins 644 exert a force E1 on the sleeve 40 pressing the sleeve 40 against the bottom 262. The bottom 262 then exerts a reaction force E2 on the sleeve 40. In other words, the sleeve 40 is compressed between the end surface 644A of the fins 644 and the bottom 642. This compression of the sleeve 40 results in radially expanding it relative to the axes X26 and X40, which are then combined, which firmly presses the portions 44 and 46 of its outer surface against the surface defining the bore 26 inside the base 20, at its portions 267, 268, respectively. The sealing between the elements 20 and 40 is thus ensured lastingly. This sealing is obtained owing to the elastically deformable nature of the sleeve 40, radially relative to the axis X40.

In this fitting configuration, the needle 62 extends parallel to the axis X26. In practice, it extends along the axis X26 and the distal end 622 of the needle 22 is engaged in the volume V28, without coming into contact with the inner surface of the punch 28. The punch 28 therefore mechanically protects said distal end 622, without any risk of pollution.

Figure 2:
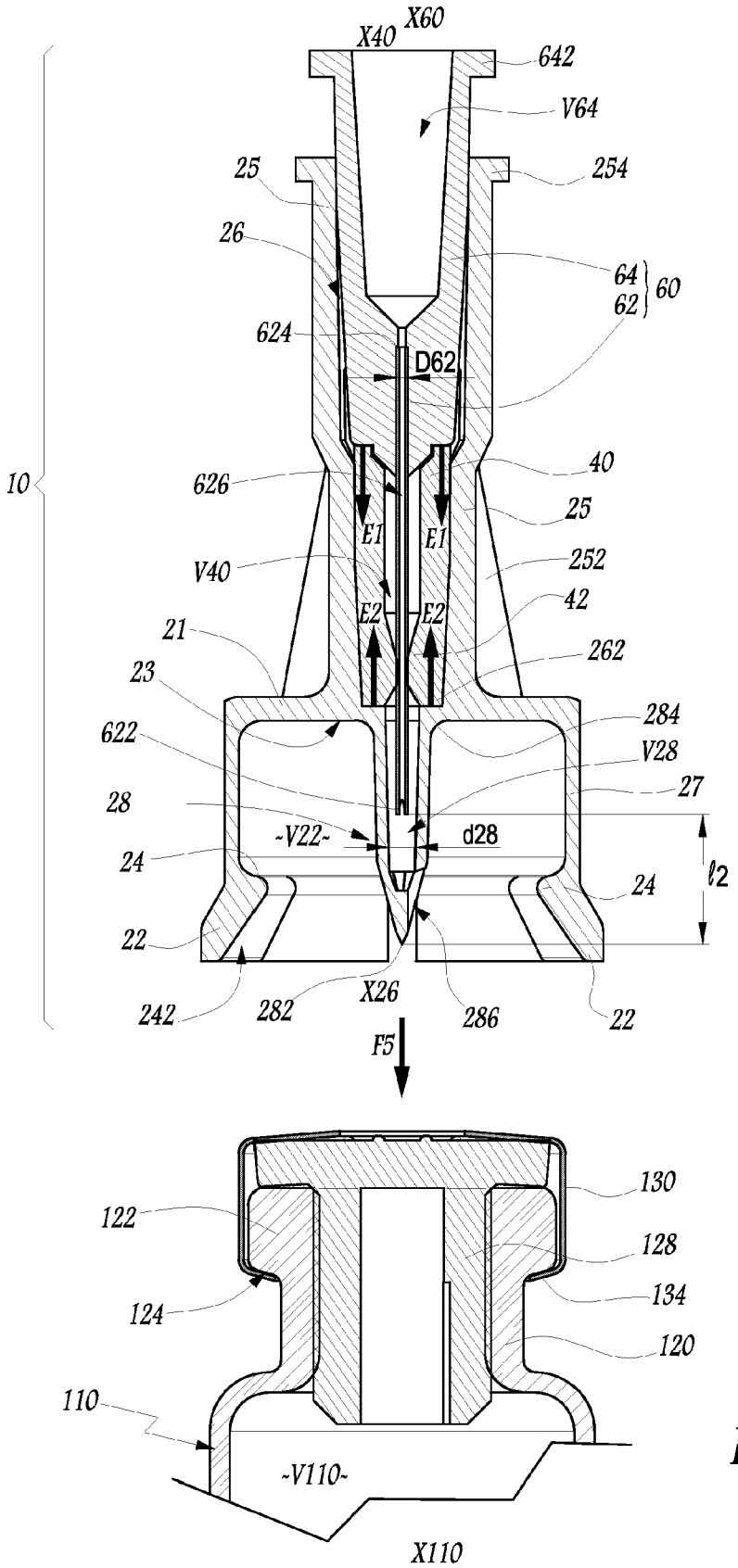
FIG. 2 is an axial cross-section of the device of FIG. 1 above a bottle whereof the neck is closed off by a penetrable stopper.

In the fitted configuration shown in FIGS. 2 and 3, the distal end 622 of the needle 62 is offset, along the axes X26 and X60, which are combined, by a length $l_2$ relative to the distal end 282 of the punch 28. The length $l_2$ is greater than 2 mm, preferably greater than 3 mm, which makes it possible to reduce the dead space around the needle 62 when the bottle 1 equipped with the device 10 is turned over in the position of FIG. 12.

When the device 10 is mounted on the bottle 110, as shown in particular in FIG. 3, the punch 28 has penetrated the stopper 128 due to the engagement of the tabs 22 below the collar 122, such that the volume V28 communicates with the inner volume V110 of the bottle 110, through the opening 286. Inasmuch as the distal end 622 of the needle 62 is positioned in that volume V28, the central channel 626 of the needle 62 thus communicates with the volume V110, through the volume V28, the opening 286 and the volume V22. In light of its single-component nature with the rest of the base 20 and in particular with the annular part 21, the punch 28 is made to penetrate the stopper 128 due solely to the mounting of the base 20 on the recipient 10, without interaction with a syringe or another member outside the device 10.

Thus, the device 10 makes it possible to put the channel 626 and the volume V110 in communication, while protecting the distal end 622 of the needle 62 that is mounted on the base 20, within the device 10, before placing that device on the bottle 110.

D62 denotes the outer diameter of the needle 62, the diameter being constant over the length of the needle. The diameter d40 is chosen to be smaller than the diameter D62. In practice, the difference between these diameters may be comprised between 5% and 25% of the diameter. This ensures effective sealed bearing between the sleeve 40 and the needle 62, in the zone 42. This also ensures, when the subassembly 60 is removed relative to the base 20 as explained hereinafter, wiping by friction of the outer surface of the needle 62, at the level of its part received in the volume V28.

As emerges from FIG. 3, in the configuration shown in figure, the dead space of the assembly formed by the device 10 and the bottle 110 comprises an inner volume part V28 of the punch 28 and an inner volume portion V'40 of the sleeve 40 that extends between the volume V28 and the narrow zone 42 of the sleeve 40 that is in contact with the needle 62. This dead space also comprises a part V128 of the inner volume of the stopper 128 that extends between the bottom of said stopper and the opening 286. This dead space is shown grayed out in FIG. 3. It is substantially smaller than in the known materials, in particular because it practically does not extend above the punch 28, since the narrow zone 42 is close to the lower end of the sleeve 40. This dead space made up of the volumes V28, V'40 and V128 has a value smaller than 25 $mm^3$, in practice smaller than 22 $mm^3$ (cubic millimeters).

A method for assembling the device 10 is shown in FIGS. 5 to 8. In this method, a tube 310 secured to a support 320 is used, as well as a plate 330 that is translatable relative to the support 320 and the tube 310.

The tube 310 is chosen such that its outer diameter D310 is compatible with its insertion in the sleeve 40, subject to elastic deformation thereof. The inner diameter d310 of the tube 310 is chosen to be strictly larger than the diameter d62.

Figure 5:
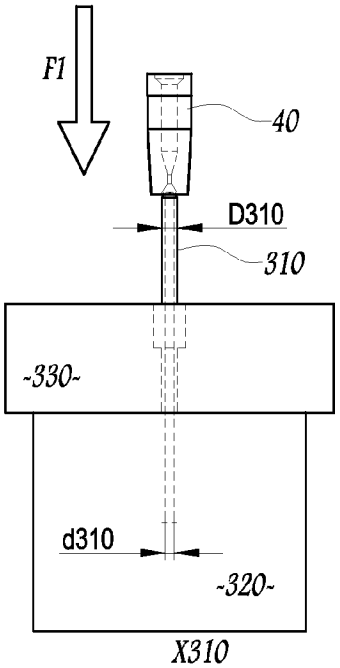

In a first step shown in FIG. 5, the sleeve 40 is fitted around the part of the tube 310 that protrudes past the plate 330. This is represented by arrow F1 in that figure.

Figure 6:
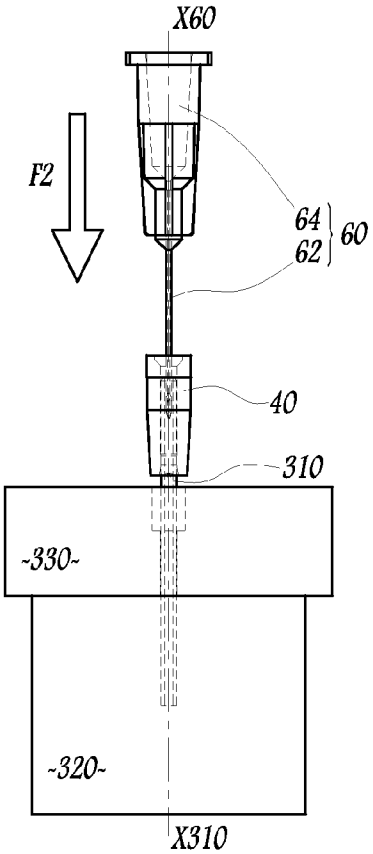

In a second step shown in FIG. 6, the subassembly 60 is positioned relative to the sleeve 40 by aligning the axis X60 with the central axis X310 of the tube 310, then the needle 62 is engaged in the tube 310, which is possible owing to the difference between the diameters D62 and d310. This operation is represented by arrow F2 in FIG. 6. It occurs without any contact between the sleeve 40 and the needle 62.

Figure 7:
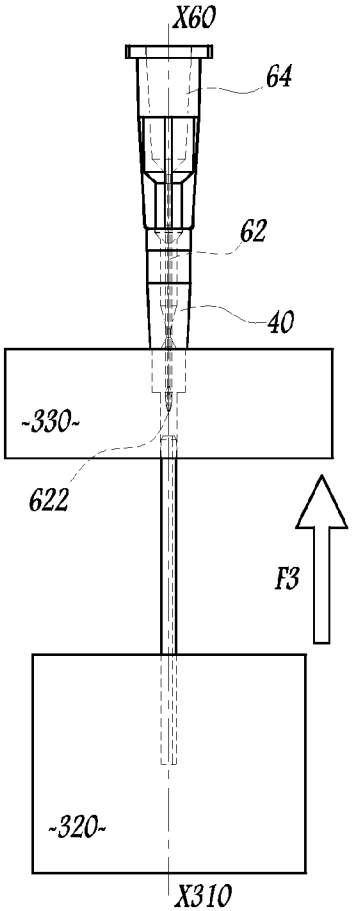

In a third step shown in FIG. 7, the plate 330 is separated from the support 320, in translation along the axis X310 and the axis X60, as shown by arrow F3, which results in removing the tube 310 from the sleeve 40 then placed on the needle 62. At the end of this step, the elements 60 and 40 are preassembled, and the distal end 622 of the needle 62 protrudes past the sleeve 40 without having been in direct contact therewith, therefore without any risk of pollution of that end 622 by the material making up the sleeve 40.

Figure 8:
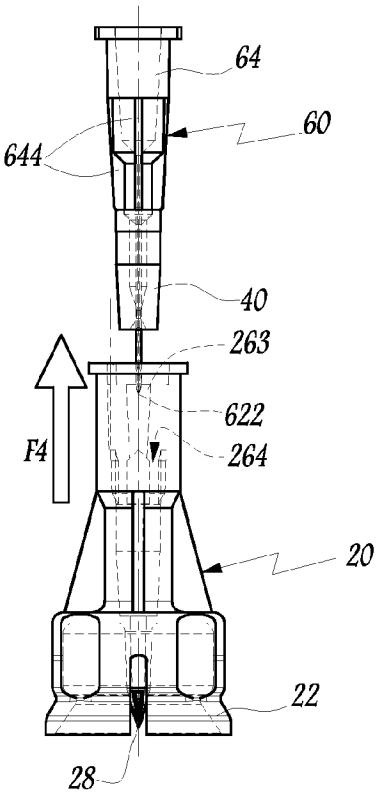
FIGS. 5 to 8 are side views showing the steps of a method for assembling the device of FIGS. 1 to 4, and FIGS. 9 to 13 show the steps of a method for reconstituting a medicament, in which a syringe is filled with a product contained in a bottle, using the device of FIGS. 1 to 4.

In a fourth step shown in FIG. 8, the base 20 is attached around preassembled elements 60 and 40, as shown by the arrow F4. During the movement, the axes X26, X40 and X60 are aligned. The distal end 622 of the needle 62 is inserted as far as into the inner volume V28 without coming into contact with the base 20.

In this respect, it will be noted that the minimum inner diameter d28 of the punch 28 is larger than the diameter D62. In practice, the diameter d28 may be between two and four times greater than the diameter D62.

Figure 9:
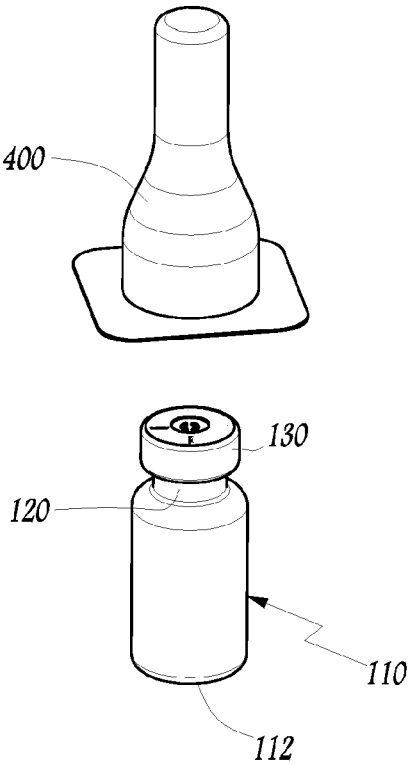
Figure 10:
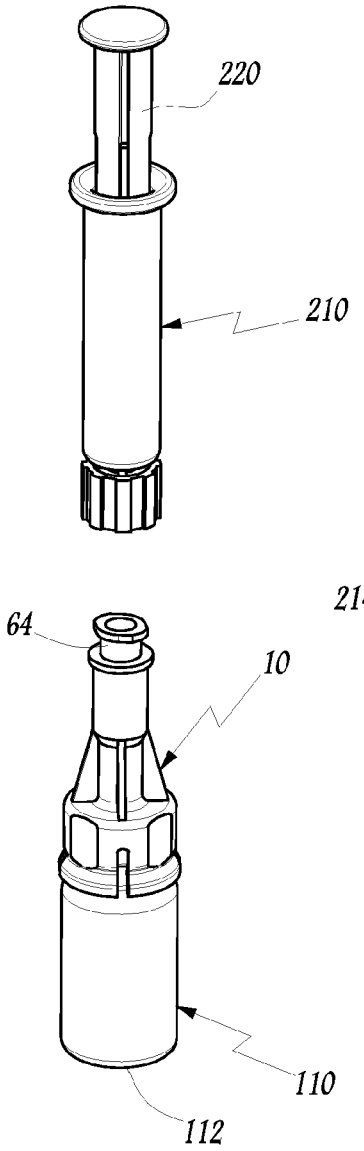

Before use, the device 10, which is compact, may be stored in a blister 400, as shown in FIG. 9. When the contents of the bottle 110 need to be recovered, the blister 400 is opened and the device 10 is mounted on the neck 120 of the bottle 110 by placing it on that neck, then exerting thrust toward the bottom 112 in the direction of arrow F5 in FIG. 2. This makes it possible to transition the device 10 from the configuration of FIG. 2 to that of FIGS. 3 and 10, subject to elastic deformation of the tabs 22. This causes the stopper 128 to be penetrated by the punch 28.

It is then possible to mount, reversibly on the tip 64, a syringe 210 that is equipped with a nut 214 for locking on the tip 64. Locking of the luer or luer-lock type may be used. Alternatively, other types of locks may be considered.

Figure 11:
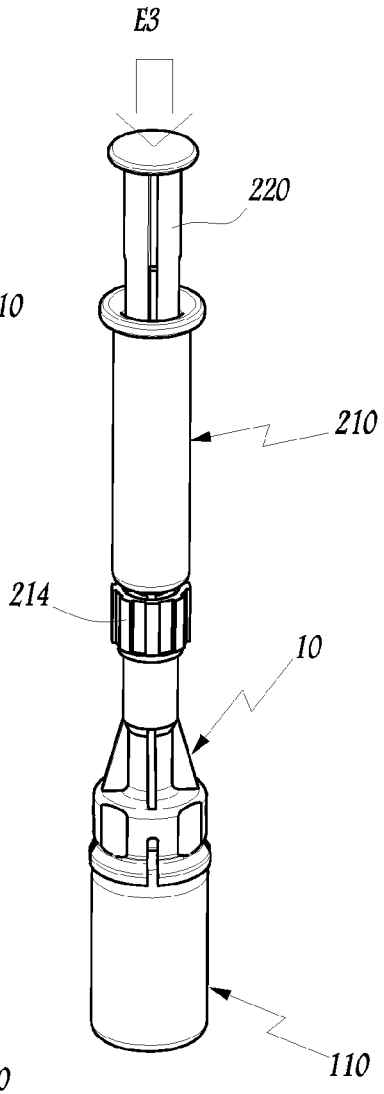

A thrust force E3 may then be exerted on the piston 220 of the syringe 210, which results in injecting a liquid contained in the syringe 210 inside the bottle 110, as shown in FIG. 11. This is possible inasmuch as, by going from the configuration of FIG. 2 to that of FIG. 3, the punch 28 has penetrated the stopper 128, such that the liquid contained in the syringe 210 can flow through the volume V64, the channel 626, the volume V28, the opening 286 and the volume V22, until reaching the volume V110.

Figure 12:
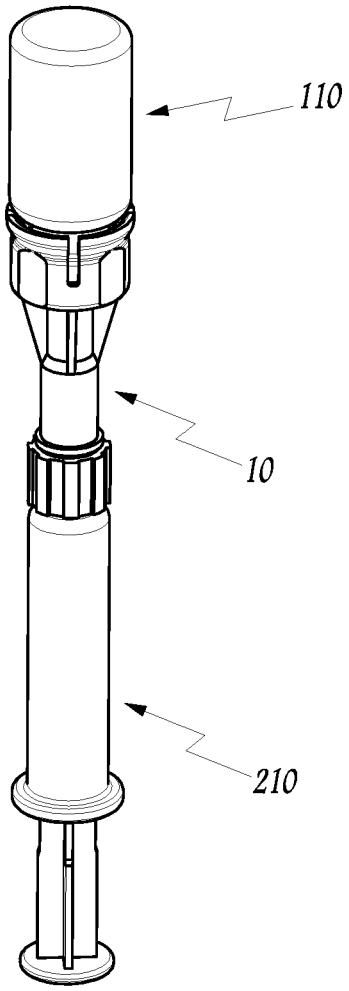
Figure 13:
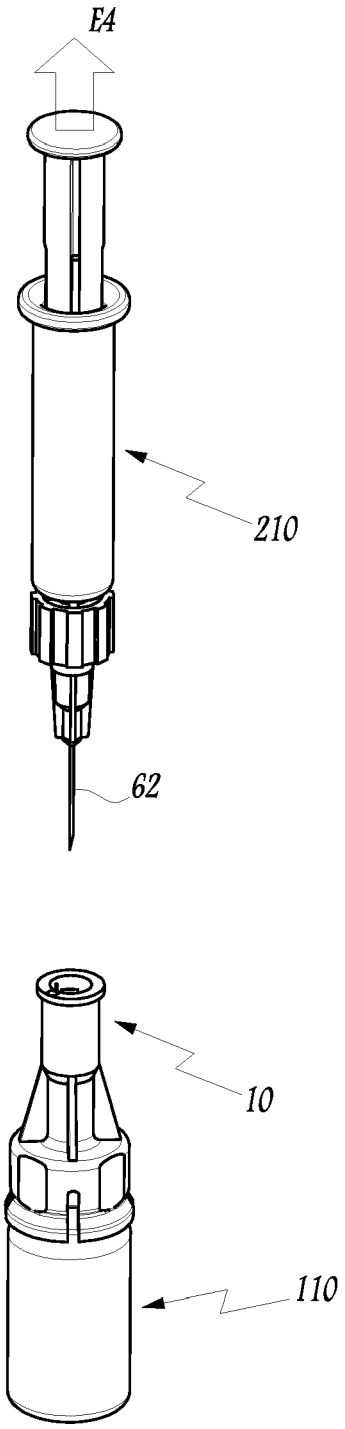

It is then possible to shake the elements 10, 110 and 210 thus connected and put in communication to homogenize the contents of the bottle 110, then to turn that assembly over, as shown in FIG. 12, which allows the contents of the bottle 110 to flow by gravity toward the syringe 210, by passing in the volume V22, the opening 286, the volume V28, the channel 626 and the volume V64. In that position, the reconstituted product dead space is that which surrounds the needle 632 in the volume V28. In light of the value of the length $l_2$, that dead space is relatively small.

In this configuration, the elastic and sealed bearing of the sleeve 40 around the needle 62 guarantees that the contents of the bottle 110 will not leak into the volume V40, below the portion 42.

By turning the assembly thus formed over again, it is possible to separate the syringe from the bottle 10, by exerting an axial pulling force E4 relative to the base 20, which extracts the subassembly 60 from the base 20 with the needle 62 mounted on the syringe 210 in the usage configuration.

This extraction movement causes cleaning of the distal part of the needle 62 by the sleeve 40, as explained above.

It will be noted that the device 10 according to the invention is particularly simple and intuitive to use, by exerting only axial forces, except to connect the syringe 210 on the tip 64, and it comprises three main parts, i.e., the base 20 and the sleeve 40, which are a single component, and the subassembly 60 made up of two pieces.

The invention claimed is:

1. A device for connection between a recipient and a container comprising:

a base provided with mounting means for assembly on a recipient provided with a neck closed off by a penetrable stopper, which defines a central bore and on which a container intended to be equipped with a needle can be mounted, the base being a single component comprising a penetrating member for penetrating the penetrable stopper that extends, from an intermediate wall of the base, opposite the central bore, parallel to a central axis of the central bore and as far as a distal end, the penetrating member being hollow and its inner volume being in communication with the central bore, and with a volume radially surrounding the distal end of the penetrating member;

a subassembly engaged in the central bore that is mountable on the container, comprising a needle positioned in the central bore, in a direction parallel to a longitudinal axis of the central bore; and a sealing sleeve positioned in the central bore, around the needle and in contact therewith.

2. The device according to claim 1, wherein the inner volume of the penetrating member forms a housing for partially receiving the needle.

3. The device according to claim 2, wherein a part of the needle that is received in the inner volume of the penetrating member is not in contact with the penetrating member.

4. The device according to claim 2 wherein a free end of a part of the needle received in the inner volume of the penetrating member is offset, in a direction parallel to the longitudinal axis of the bore, by at least 2 mm relative to the distal end of the penetrating member.

5. The device according to claim 1, wherein a minimum inner diameter without strain of the sleeve is smaller than an outer diameter of the needle.

6. The device according to claim 1, wherein the base and a tip secured to the needle are provided with complementary raised portions for locking the needle in a translational movement parallel to the longitudinal axis of the bore, toward the penetrating member.

7. The device according to claim 6, wherein the sleeve bears, opposite the tip, against a bottom of the bore wherein, when the tip is locked against the base by cooperation of the complementary raised portions, it exerts an axial compression force on the sleeve, and wherein the sleeve expands radially under the effect of such compression force.

8. The device according to claim 1, wherein an outer surface of the sleeve comprises a cylindrical portion with a circular base, and a frustoconical portion.

9. The device according to claim 1, wherein the penetrating member is provided to penetrate the penetrable stopper of the recipient due solely to the mounting of the base on the recipient, without any interaction with the container.

10. The device according to claim 1, wherein a dead space of the device extends into the inner volume of the penetrating member, into the sleeve as far as a narrow zone of the sleeve in contact with the needle and around the penetrating member.

11. The device according to claim 10, wherein the dead space of the device is smaller than 25 $mm^3$.

12. The device according to claim 1, wherein the subassembly comprises a tip mounted around a proximal end of the needle, the tip being provided with means for removable attachment on the container.

13. A method for assembling a device according to claim 1, comprising:

engaging, owing to an elastic deformation, the sleeve on a tube whereof an inner diameter of the tube is larger than an outer diameter of the needle;

aligning a central axis of the needle on a central axis of the tube and engaging the needle in the tube with a translational movement parallel to the aligned axes;

separating, through a translational movement parallel to the aligned axes, the tube from the subassembly; and engaging the subassembly in the central bore of the base.

14. A method for filling a container, wherein a device according to claim 1 is used, the method comprising:

mounting the base on the recipient by penetrating the penetrable stopper with the penetrating member, through an operation resulting from the movement of the base relative to the neck, in translation parallel to the central axis of the bore and toward a bottom of the recipient;

sealably mounting the container on a tip secured to a proximal end of the needle;

injecting, in the recipient, a liquid present in the container, through a central channel of the needle and the inner volume of the penetrating member;

positioning the recipient, the device and the container assembled in a position where the contents of the recipient flow by gravity toward an inner volume of the container, through the inner volume of the penetrating member and the central channel of the needle; and removing the needle secured to the container from the bore.

15. The method according to claim 14, wherein during said mounting the base, the mounting means are elastically deformed and attach below the neck of the recipient, while keeping the penetrating member in a position where it puts an inner volume of the recipient in communication with an inner volume of a part of the subassembly in place in the central bore of the base.

* * * * *